US005297791A

United States Patent [19]

Negishi

[11] Patent Number: 5,297,791

[45] Date of Patent: Mar. 29, 1994

[54] GOLF CLUB SHAFT AND METHOD OF PRODUCING THE SAME

[75] Inventor: Isamu Negishi, Tokyo, Japan

[73] Assignee: Fujikura Rubber Ltd., Tokyo, Japan

[21] Appl. No.: 960,240

[22] Filed: Oct. 13, 1992

Related U.S. Application Data

[63] Continuation-in-part of Ser. No. 708,746, May 31, 1991, abandoned.

[30] Foreign Application Priority Data

Jun. 4, 1990 [JP] Japan ..... 2-144379

[51] Int. Cl.[5] ..... A63B 53/10; A63B 53/12

[52] U.S. Cl. ..... 273/80 R; 273/80 B

[58] Field of Search ..... 273/80 R, 80 A, 80 B, 273/80 C, 193 R, 194 R, 77 R, 77 A, 186.2, 187.4

[56] References Cited

U.S. PATENT DOCUMENTS

| | | | |
|---|---|---|---|
| 1,418,038 | 5/1922 | Tousey | 273/80 R |
| 1,670,531 | 5/1928 | Cowdery | 273/80 B |
| 1,688,473 | 10/1928 | Sippel | 273/80 B |
| 2,023,131 | 12/1935 | Gibson | 273/80 B |
| 3,083,969 | 4/1963 | Bills | 273/80 R |
| 3,764,137 | 10/1973 | Petro | 273/80 B |
| 4,188,032 | 2/1980 | Yanagioka | 273/80 R |
| 4,725,060 | 2/1988 | Iwanaga | 273/77 A |
| 5,004,236 | 4/1991 | Kamesaima | 273/80 B |
| 5,042,805 | 8/1991 | Nakai | 273/80 B |

FOREIGN PATENT DOCUMENTS

| | | | |
|---|---|---|---|
| 8606286 | 11/1986 | European Pat. Off. | 273/80 R |
| 24769 | of 1912 | United Kingdom | 273/80 R |
| 471020 | 8/1937 | United Kingdom | 273/80 B |
| 1201648 | 8/1970 | United Kingdom | 273/80 R |
| 2053004 | 2/1981 | United Kingdom | 273/80 B |
| 2053698 | 2/1981 | United Kingdom | 273/80 B |
| 2227418 | 8/1990 | United Kingdom | 273/77 A |

OTHER PUBLICATIONS

"Golf World", Magazine, Apr. 12, 1968 issue, Advertisement for "Hex Flex" Shafts.

*Primary Examiner*—Vincent Millin
*Assistant Examiner*—Sebastiano Passaniti
*Attorney, Agent, or Firm*—Koda and Androlia

[57] ABSTRACT

A golf club shaft having a vibration preventing piece firmly mounted thereon for improving a feeling to be received by a player when he hits a golf ball with his golf club is disclosed. The vibration preventing piece is firmly mounted on a golf club shaft at the position defined by an inequality of $1.8 \geqq c/d \geqq 0.35$ wherein c designates a distance between the tip side of the golf club shaft and a center of the vibration preventing piece and d designates a distance between the butt side of the golf club shaft and the center of the vibration preventing piece. Further, a method of producing a golf club shaft of the foregoing type is practiced by way of the steps of winding at least one prepreg sheet composed of reinforcement fibers and a thermosetting plastic around a rod-shaped mandrel, drawing the mandrel after completion of a thermal setting operation and firmly mounting a vibration preventing piece made of a shape memory alloy around a layered sheet product at the position located within the distance range defined by an inequality of $1.8 \geqq c/d \geqq 0.35$ wherein c designates a distance between the tip side of the golf club shaft and the center of the vibration preventing piece and d designates a distance between the butt side of the golf club shaft and the center of the vibration preventing piece. The shape memory alloy is constructed in the annular configuration such that it assumes predetermined dimensions by thermal contraction thereof.

4 Claims, 1 Drawing Sheet

GOLF CLUB SHAFT AND METHOD OF PRODUCING THE SAME

This is a continuation-in-part of application Ser. No. 708,746, filed May 31, 1991, now abandoned.

BACKGROUND OF THE INVENTION

1. Field of the Invention

The present invention relates generally to a golf club shaft. More particularly, the present invention relates to a golf club shaft which assures that a player can stably perform a swinging operation with his golf club while enjoying an excellent strike feeling when he hits a golf ball with the golf club.

Further, the present invention relates to a method of producing a golf club shaft of the aforementioned type wherein the golf club shaft can be produced easily.

2. Description of the Related Art

A golf club is generally constructed such that a head made of a metallic material, a wood, a carbon or the like material is fixedly secured to the fore end (tip side) of a golf club shaft and a grip is fixedly secured to the opposite end (butt side) of the golf club shaft.

The golf club shaft is flexibly deformed while vibrating at a certain frequency when a player hits a golf ball with his golf club, whereby the golf ball is shot by a long distance with a high accuracy.

Since the golf club shaft is adapted to vibrate when he hits the golf ball, vibrations are transmitted to player's hands. When he hits the golf ball correctly, he receives fine vibrations without any unpleasant feeling. However, when he hits the golf ball incorrectly, he receives a high intensity of vibrations with an unpleasant numb feeling.

Once he has received the unpleasant feeling in this way, there is a possibility that he can not perform a stable swinging operation with his golf club any more for the psychological reason.

SUMMARY OF THE INVENTION

The present invention has been made with the foregoing background in mind.

An object of the present invention is to provide a golf club shaft which assures that unpleasant vibrations induced when a player hits a golf ball with his golf club are hardly transmitted to the butt side of the golf club shaft.

Other object of the present invention is to provide a golf club shaft which assures that the player can enjoy an excellent strike feeling at the time of a swinging operation and moreover the swinging operation can be performed stably with his golf club.

Another object of the present invention is to provide a method of producing a golf club shaft of the aforementioned type wherein the golf club shaft can be produced easily.

To accomplish the above objects, the present invention provides a golf club shaft for a golf club, wherein at least one vibration preventing piece is disposed at the position located within the distance range defined by an inequality of $1.8 \geqq c/d \geqq 0.35$ wherein c designates a distance between the tip side of the golf club shaft and a center of the vibration preventing piece and b designates a distance between the butt side of the golf club shaft and the center of the vibration absorbing piece.

In addition, the present invention provides a method of producing a golf club shaft for a golf club, wherein the method is practiced by way of the steps of winding at least one prepreg sheet composed of reinforcement fibers and a thermosetting resin around a rod-shaped mandrel, allowing the prepreg sheets to be subjected to thermal setting; drawing the mandrel from the layered sheet product after completion of the thermal setting operation; and firmly mounting a vibration preventing piece made of a shape memory alloy around the cylindrical layered sheet product at the position located within the distance range defined by an inequality of $1.8 \geqq c/d \geqq 0.35$ wherein c designates a distance between the tip side of the golf club shaft and a center of the vibration preventing piece and d designates a distance between the butt side of the golf club shaft and the center of the vibration preventing piece, the vibration preventing piece being constructed in the annular configuration such that it assumes predetermined dimensions by thermal contraction thereof, the predetermined dimensions being previously memorized in the shape memory alloy.

Further, the present invention provides a method of producing a golf club shaft for a golf club, wherein the method is practiced by way of the steps of winding at least one prepreg sheet composed of reinforcement fibers and a thermosetting resin material around a rod-shaped mandrel; mounting a vibration preventing piece made of a shape memory alloy around the layered sheet product at the position located within the distance range defined by an inequality of $1.8 \geqq c/d \geqq 0.35$ wherein c designates a distance between the tip side of the golf club shaft and a center of the vibration preventing piece and d designates a distance between the butt side of the golf club shaft and the center of the vibration preventing piece, the vibration preventing piece being constructed in the annular configuration such that the shape memory alloy assumes predetermined dimensions by thermal contraction thereof, the predetermined dimensions being previous memorized in the shape memory alloy; allowing the prepreg sheets to be subjected to thermal setting; and drawing the mandrel from the layered sheet product after completion of the thermal setting operation.

With the golf club shaft of the present invention, the vibration preventing piece having a certain weight is firmly mounted around the golf club shaft which in turn is assembled with a head and a grip to produce a golf club. By virtue of arrangement of the vibration preventing piece in the abovedescribed manner, vibrations induced when a player hits a golf ball with his golf club are hardly transmitted to player's hands.

In addition, with the method of the present invention, the vibration preventing piece is made of a shape memory alloy adapted to be thermally contracted to assume predetermined dimensions. Thus, the vibration preventing piece can firmly be mounted around the golf club shaft in the embedded state, which prevents it from being displaced in the axial direction of the golf club shaft. Consequently, a player can enjoy an excellent strike feeling for a long period of time with his golf club having the golf club shaft of the present invention used therefor.

Other objects, features and advantages of the present invention will become apparent from reading of the following description which has been made in conjunction of the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
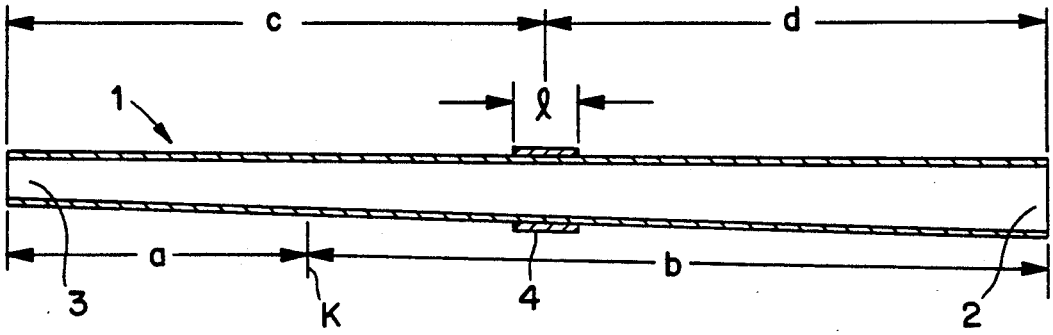
FIG. 1 is a sectional view of a golf club shaft in accordance with an embodiment of the present invention.

FIG. 1 is a sectional view which shows the structure of a golf club shaft in accordance with an embodiment of the present invention. As is apparent from the drawing, the golf club shaft generally designated by numeral 10 is constructed such that its diameter is gradually reduced from the grip fitting side, i.e., the butt side 2 toward the head fitting side or end, i.e., the tip side 3. When it is assumed that a distance from the tip side 3 to a kick point K is designated by a and a distance from the butt side 2 to the kick point K is designated by b, a vibration preventing piece 4 is firmly mounted on the golf club shaft 1 within the distance range as defined by the following inequality.

$$1.8 \geqq c/d \geqq 0.35$$

In the above inequality c is the distance from the tip end 3 to a center of the vibration preventing piece 4 and d is a distance from the butt end 2 to the center of the vibration preventing piece 4.

Here, the kick point refers to a location which coincides with the center of a curved contour appearing when a certain intensity of force is exerted on opposite ends of the golf club shaft 1 so as to allow the golf club shaft 1 to be bent.

If the position where the vibration preventing piece 4 is firmly mounted on the golf club shaft 1 departs away from the above-defined distance range, the result is that an effect for suppressing transmission of vibrations is undesirably reduced and there is a possibility that a property of swing feeling is deteriorated.

The vibration preventing piece 4 may be made of a metallic material which is preformed in the annular configuration so as to surround a part of the outer peripheral surface of the golf club shaft 1. For example, a Cu-Zn-Al-Mn based, Cu-Zn-Al based or Ti-Ni based shape memory alloy or a vibration suppressing alloy can be used for the vibration preventing piece 4. Alternatively, a rubber, a plastic resin or the like non-metallic material may be employed in place of the metallic material.

Figure 2A:
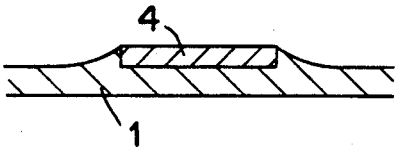
FIG. 2 is a fragmentary view which schematically illustrates an essential part of the golf club shaft shown in FIG. 1 on an enlarged scale.
Figure 2B:
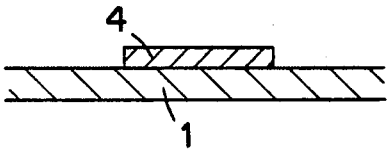

Especially, in a case where the shape memory alloy is employed for the vibration preventing piece 4 when a golf club shaft is produced by resins, for example a so-called carbon shaft, the vibration preventing piece 4 is firmly mounted on the golf club shaft 1 in such a manner that an annular shape having predetermined dimensions is previously memorized in the shape memory alloy, the vibration preventing piece 4 is fitted onto the golf club shaft 1 after completion of a coating operation (see FIG. 2(*b*)) and the vibration preventing piece 4 is then embedded in a part of the golf club shaft 1 by thermally contracting the vibration preventing piece 4 thereby to restore predetermined dimensions from the dimensions which have been memorized in the shape memory alloy by heating it (see FIG. 2(*a*)). In such manner, the vibration preventing piece 4 can firmly be mounted on the golf club shaft 1 at the predetermined position.

On the other hand, in a case where the vibration suppressing alloy is employed for the vibration preventing piece 4, it has been found that vibrations (striking vibrations) induced when a player hits a golf ball with his golf club can be absorbed in the vibration preventing piece 4 more excellently.

It is preferable from the viewpoint of an easy fitting operation that the vibration preventing piece 4 is designed in the annular configuration. However, the present invention should not be limited only to this configuration.

It is desirable that a length l of the vibration preventing piece 4 in the longitudinal direction of the golf club shaft 1 is dimensioned within the range of 5 to 30 mm. If the length l is dimensioned shorter than 5 mm, it is difficult to absorb vibrations. On the other hand, if the length l exceeds 30 mm, it is difficult to integrate the vibration preventing piece 4 with the golf club shaft 1.

As will be readily apparent from the above description, a weight of the vibration preventing piece 4 is an important factor for the golf club shaft of the present invention from the viewpoint of suppressing transmission of the striking vibrations to player's hands. It is preferable that the weight of the vibration preventing piece 4 remains within the range of 0.5 to 12 grams. If it is less than 0.5 gram, there is a possibility that transmission of the vibrations can not be suppressed. On the other hand, if it exceeds 12 grams, there is a possibility that a swinging operation can not be performed in the well-balanced state by the player.

It is obvious from the above description that a wall thickness of the vibration preventing piece 4 should preferably be reduced in order to assure that a large magnitude of step does not appear on the golf club shaft 1. It is acceptable from the viewpoint of design that it is equal or less than 3 mm.

Next, a method of producing a golf club shaft in accordance with other embodiment of the present invention will be described below.

Figure 3:
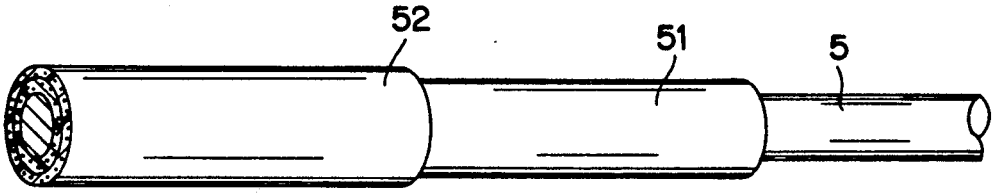
FIG. 3 is a perspective view which schematically illustrates a method of producing a golf club shaft in accordance with another embodiment of the present invention.

To practice the method of the present invention, first, a rod-shaped mandrel 5 is prepared. Then, two prepreg sheets each composed of reinforcement fibers such as carbon fibers arranged in parallel with each other in a certain direction and a thermosetting resin such as an epoxy resin are superimposed one above another while the reinforcement fibers in one of the prepreg sheets intersect the reinforcement fibers in the other prepreg sheet with a certain intersectional angle such as a right angle or the like defined therebetween, and the resultant layered sheet material is continuously wound around the mandrel 5 to form a multi-layered structure having a coil-shaped configuration as seen in the cross-sectional plane which serves as a torsion preventing layer 51. After formation of the torsion preventing layer 51, another prepreg sheet composed of reinforcement fibers and a thermosetting resin in the same manner as mentioned above is continuously wound around the torsion preventing layer 51 to form another multi-layered structure which serves as a rigidity maintaining layer 52. It should be added that the reinforcement fibers in the prepreg sheet for the rigidity maintaining layer 52 extends in parallel with the axial direction of the mandrel 5, as shown in FIG. 3. Each of the torsion preventing layer 51 and the rigidity maintaining layer 52 may be formed in a single-layered structure. Alternatively it may be formed in a multi-layered structure.

Thereafter, the prepreg sheets constituting the torsion preventing layer 51 and the prepreg sheet constituting the rigidity maintaining layer 52 are thermally set. After completion of the thermal setting operation for the torsion preventing layer 51 and the rigidity maintaining layer 52, the mandrel 5 is drawn from the layered sheet product comprising the torsion preventing layer 51 and the rigidity maintaining layer 52. The outer surface of the resultant cylindrical layered sheet product is ground and coated with a suitable finish coating material. Thereafter, a vibration preventing piece 4 made of a shape memory alloy of which annular configuration has been previously memorized therein with certain dimensions is fitted onto the cylindrical layered sheet product and it is then thermally contracted to predetermined dimensions by heating the vibration preventing piece 4 only. As the vibration preventing piece 4 is thermally contracted in that way, it is firmly mounted around the cylindrical layered sheet product in the embedded state as shown in FIG. 2(*a*).

As described above, since the vibration preventing piece 4 is firmly mounted around the golf club shaft with the annular configuration of which dimensions have been once memorized in the shape memory material, there is no possibility that the vibration preventing piece 4 is axially displaced from the embedded position.

Next, a method of producing a golf club shaft in accordance with another embodiment of the present invention will be described below.

According to this embodiment, first, a rod-shaped mandrel 5 is prepared. Then, two prepreg sheets each composed of reinforcement fibers and a thermosetting resin are superimposed one above another while the reinforcement fibers in one of the prepreg sheets intersect the reinforcement fibers in the other prepreg sheet with a certain intersectional angle, and the resultant layered sheet material is continuously wound around the mandrel 5 to form a multi-layered structure which serves as torsion preventing layer 51. After formation of the torsion preventing layer 51, another prepreg sheet composed of reinforcement fibers and a thermosetting resin is continuously wound around the torsion preventing layer 51 to form another multi-layered structure which serves as a rigidity maintaining layer 52 while the reinforcement fibers in the prepreg sheet extend in parallel with the axial direction of the mandrel 5 in the same manner as the preceding embodiment.

While the foregoing state is maintained, a vibration preventing piece 4 made of a shape memory alloy in the annular configuration is mounted around the layered sheet product comprising the torsion preventing layer 51 and the rigidity maintaining layer 52 at a predetermined position. Then an assembly of the layered sheet product and the vibration preventing piece 4 is subjected to thermal setting which causes the shape memory alloy constituting the vibration preventing piece 4 to assume a predetermined configuration. Thereafter, production of the golf club shaft is completed by drawing the mandrel 5 from the assembly.

EXAMPLE

Two prepreg sheets each composed of carbon fibers and a thermosetting resin were superimposed one above another such that the carbon fibers in one of the prepreg sheets intersect the carbon fibers in the other prepreg sheet with a certain intersectional angle defined therebetween. The resultant layered sheet material was continuously wound around a rod-shaped mandrel to form a torsion preventing layer. Thereafter, another prepreg sheet composed of carbon fibers extending in the longitudinal direction of the mandrel and a thermosetting resin was continuously wound around the layered sheet product to form a rigidity maintaining layer. After the intermediate layered sheet product was thermally set by heating it, the mandrel was drawn therefrom and the outer surface of the cylindrical layered sheet product was then ground and coated with a suitable finish coating material, whereby a golf club shaft was produced.

A pipe made of a Cu-Zn-Al based shape memory alloy, of which dimensions were previously memorized therein so as to assume an inner diameter of 10.40 mm in practical use, was fitted onto the golf club shaft at the position where it had an outer diameter of 10.35 mm, after an epoxy based adhesive was coated on the region inclusive of the above position. Then, the pipe was firmly mounted around the golf club shaft by thermally contracting the pipe only by blowing a hot air having a temperature of about 120° C. toward the pipe.

In this example, the ratio of c/d designating the position where the pipe was firmly mounted around the golf club shaft was 0.65, the length l of the pipe in the axial direction of the golf club shaft was 15 mm, a weight of the pipe was 3.5 gram and a wall thickness of the same was 2 mm.

It was confirmed that the pipe made of a shape memory alloy was firmly mounted around the golf club shaft at a predetermined position and moreover the golf club shaft as shown in FIG. 1 could be produced easily.

A golf club was produced using the golf club shaft of the present invention which was produced in the above-described manner. It was found that an unpleasant feeling received by a player when he incorrectly hit a golf ball with the golf club was substantially suppressed and his hands were hardly numbed by the incorrect hitting operation.

Next, damping characteristics and a resonance property were measured with respect to the golf club of the present invention and a conventional golf club including no vibration preventing piece (Comparative Example). Results derived from the measurements are as shown in the following table.

TABLE

| | present invention | comparative example | measuring condition |
|---|---|---|---|
| damping characteristics (second) | 0.06 | 0.12 | 2KHz |
| resonance | 0.1 | 0.65 | 165Hz |
| property | 0.12 | 0.18 | 300Hz |
| (G/N) | 0.12 | 0.23 | 500 to 600Hz |

The present invention has been described above with respect to a golf club shaft made of a plastic material. However, the present invention should not be limited only to this. It is obvious that the present invention is equally applicable to a golf club shaft made of a metallic material with the same advantageous effects as those with the golf club shaft made of a plastic material.

As will be readily apparent from the above description, the golf club shaft of the present invention is constructed such that a metallic piece is disposed at the position in the vicinity of a kick point on a golf club having the golf club shaft of the present invention used therefor. With this construction, a player receives few numbness and unpleasant feeling when he hits a golf ball with his golf club. Consequently, he can enjoy an excellent feeling during a swinging operation and moreover he can perform a stable swinging operation.

What is claimed is:

1. In a plastic golf club shaft for a golf club having opposite tip and butt ends, the improvement comprising:

at least one vibration preventing piece made of a metal alloy disposed at a position along said shaft located within a distance range defined by an inequality of $1.8 \geqq c/d \geqq 0.35$ wherein c designates a distance between the tip end of said golf club shaft and a center of said vibration preventing piece and d designates a distance between the butt end of said golf club shaft and said center of said vibration preventing piece wherein said vibration preventing piece is located generally coincident with the kick-point of the shaft for suppressing the transmission of vibrations to a player's hands during ball impact.

2. The golf club shaft as claimed in claim 1, wherein said vibration preventing piece is constructed in an annular configuration while using a shape memory alloy or a vibration suppressing alloy.

3. The golf club shaft as claimed in claim 2, wherein said shape memory alloy is any one selected from a group of Cu-Zn-Al-Mn based alloy, Cu-Zn-Al based alloy and Ti-Ni based alloy.

4. The golf club shaft as claimed in claim 1, wherein said vibration preventing piece is dimensioned such that a thickness of said piece is equal to or less than 3 mm, a length of said piece in the axial direction of said golf club shaft remains within a range of 5 to 30 mm and a weight of said piece remains within a range of 0.5 to 12 grams.

* * * * *